US007998901B2

(12) United States Patent
Irita et al.

(10) Patent No.: US 7,998,901 B2
(45) **Date of Patent: *Aug. 16, 2011**

(54) HEAT-SENSITIVE TRANSFER IMAGE-RECEIVING SHEET AND IMAGE-FORMING METHOD

(75) Inventors: Kiyoshi Irita, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 1102 days.

This patent is subject to a terminal disclaimer.

(21) Appl. No.: 11/715,457

(22) Filed: Mar. 8, 2007

(65) Prior Publication Data

US 2007/0213218 A1 Sep. 13, 2007

(30) Foreign Application Priority Data

Mar. 9, 2006 (JP) ..... 2006-064829

(51) Int. Cl.
*B41M 5/035* (2006.01)
*B41M 5/50* (2006.01)

(52) U.S. Cl. ..... 503/227; 156/235; 428/32.51

(58) Field of Classification Search ..... None
See application file for complete search history.

(56) References Cited

U.S. PATENT DOCUMENTS

| | | | | |
|---|---|---|---|---|
| 5,529,972 | A * | 6/1996 | Ramello et al. | 503/227 |
| 7,381,685 | B2 * | 6/2008 | Oguma et al. | 503/227 |
| 7,485,402 | B2 * | 2/2009 | Arai et al. | 430/201 |

FOREIGN PATENT DOCUMENTS

| | | | |
|---|---|---|---|
| JP | 2-89690 | | 3/1990 |
| JP | 4-119889 | A | 4/1992 |
| JP | 5-193256 | | 8/1993 |
| JP | 5-229289 | | 9/1993 |
| JP | 6-155949 | A | 6/1994 |
| JP | 9-131972 | | 5/1997 |
| JP | 11-321128 | | 11/1999 |
| JP | 2000-238440 | A | 9/2000 |
| JP | 2002-254832 | A | 9/2002 |
| JP | 2004-9572 | A | 1/2004 |
| JP | 2004-106305 | A | 4/2004 |
| JP | 2005-186427 | A | 7/2005 |
| JP | 2006-62114 | A | 3/2006 |

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet, having: on a support, at least one receptor layer which contains at least one silicone compound and at least one polymer having repeating units derived from vinyl chloride; and, at least one heat insulating layer which contains hollow polymer particles, between the receptor layer and the support, in which the heat insulating layer does not contain a resin having no resistance to an organic solvent other than the hollow polymer particles.

20 Claims, No Drawings

HEAT-SENSITIVE TRANSFER IMAGE-RECEIVING SHEET AND IMAGE-FORMING METHOD

FIELD OF THE INVENTION

The present invention relates to a heat-sensitive transfer image-receiving sheet and an image-forming method thereof. Particularly, the present invention relates to a heat-sensitive transfer image-receiving sheet which enables production of an excellent image having a high density and reduced image defects, in short-time processing, and to an image-forming method thereof.

BACKGROUND OF THE INVENTION

Various heat transfer recording methods have been known so far. Among these methods, dye diffusion transfer recording systems attract attention as a process that can produce a color hard copy having an image quality closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). Moreover, this system has advantages over silver salt photography: it is a dry system, it enables direct visualization from digital data, it makes reproduction simple, and the like.

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In an image-receiving sheet on this system, a receptor layer for fixation of dyes transferred to the sheet is formed on a support, and besides, a layer having high cushion properties, such as a foam layer made up of a resin and a foaming agent or a porous layer containing hollow polymer particles, is generally formed between the support and the receptor layer with the intention of enhancing adhesion of the image-receiving sheet to a transfer sheet (see, e.g., JP-A-11-321128 ("JP-A" means unexamined published Japanese patent application) and JP-A-2-89690).

JP-A-11-321128 discloses that a receptor layer (image-receiving layer) is formed using a coating solution of resin in an organic solvent after an intermediate layer (heat insulating layer) containing as main components hollow particles and a polymer resistant to an organic solvent is formed on a support by coating and drying. Herein, the organic-solvent-resistant polymer used in the intermediate layer plays a part in preventing the hollow particles used in the intermediate layer from dissolving in the organic solvent used in the receptor layer. However, such a structure has a problem that adhesion between the intermediate layer and the receptor is poor. Since the polymer resistant to an organic solvent is used in the intermediate layer, it is self-evident that the intermediate layer has a weak affinity for the receptor layer coated with the aid of an organic solvent. Therefore, overheating at the time when an ink sheet is superposed on the image-receiving sheet and image transfer is performed causes a problem that there occurs delamination of the receptor layer at the interface between the receptor layer and the heat insulating layer or, contrary thereto, the so-called abnormal transfer, namely the transfer of an ink sheet together with a dye-keeping binder. Thus it has been required to address this problem.

Further, the heat-sensitive transfer image-receiving sheet disclosed in JP-A-2-89690 includes a hollow-spherical-pigment-dispersed layer and an image-receiving layer (a receptor layer), but it has a problem that the image after image transfer become blurred.

In addition, the cases of using vinyl chloride copolymers in receptor layers are disclosed in JP-A-5-193256, JP-A-5-229289, and JP-A-9-131972, but these receptor layers have also been desired to undergo further improvements in view of recent market requirements for rapid processing.

SUMMARY OF THE INVENTION

The present invention resides in a heat-sensitive transfer image-receiving sheet, which comprises: on a support, at least one receptor layer which contains at least one silicone compound and at least one polymer having repeating units derived from vinyl chloride; and, between the receptor layer and the support, at least one heat insulating layer which contains hollow polymer particles, wherein the heat insulating layer does not contain a resin having no resistance to an organic solvent other than the hollow polymer particles.

The present invention also resides in a n image-forming method, comprising the steps of: using the heat-sensitive transfer image-receiving sheet, and a heat-sensitive transfer sheet having dyes on a support; bringing these sheets into face-to-face contact with each other; and applying heat thereto, thereby to form a heat-sensitive transfer image.

Other and further features and advantages of the invention will appear more fully from the following description.

DETAILED DESCRIPTION OF THE INVENTION

According to the present invention, there is provided the following means:

(1) A heat-sensitive transfer image-receiving sheet, comprising: on a support, at least one receptor layer which contains at least one silicone compound and at least one polymer having repeating units derived from vinyl chloride; and, at least one heat insulating layer which contains hollow polymer particles, between the receptor layer and the support, wherein the heat insulating layer does not contain a resin having no resistance to an organic solvent other than the hollow polymer particles.

(2) The heat-sensitive transfer image-receiving sheet according to (1), wherein the heat insulating layer further contains a polymer having repeating units derived from vinyl chloride.

(3) The heat-sensitive transfer image-receiving sheet according to (2), wherein the polymer having repeating units derived from vinyl chloride is a latex.

(4) The heat-sensitive transfer image-receiving sheet according to any one of the above items (1) to (3), wherein at least one of the silicone compounds is a reactive silicone oil.

(5) The heat-sensitive transfer image-receiving sheet according to any one ofthe above items (1) to (4), wherein the receptor layer is a receptor layer coated by using a hydrophobic solvent.

(6) An image-forming method, comprising the steps of:

using the heat-sensitive transfer image-receiving sheet according to any one of the above items (1) to (5), and a heat-sensitive transfer sheet having dyes on a support;

bringing these sheets into face-to-face contact with each other; and applying heat thereto, thereby to form a heat-sensitive transfer image.

The present invention is described below in detail.

First, silicone compounds usable in the present invention are described.

Silicone compounds for use in the present invention are added as a releasing agent to a receptor layer. The addition of silicone compounds can inhibit transfer of an entire dye layer of an ink sheet and delamination of a receptor layer from a substrate, or the so-called abnormal transfer problem. Since the constitution of the present invention is somewhat weak in adhesion between the receptor layer and a lower layer thereof, the influence of whether or not the silicone compound as a releasing agent is added becomes significant.

Although solid waxes, such as carnauba wax, montan acid wax, microcrystalline wax, polyethylene wax, amide wax, and Teflon (trade name, polyamide) powder; silicone oils, phosphoric ester compounds, and fluorine-containing surfactants are known as releasing agents in the technical field concerned, silicone oils in particular have specific suitability for the constitution of the present invention.

As the silicone oil as the lubricant, straight silicone oil and modified silicone oil or their hardened products may be used.

Examples of the straight silicone oil include dimethylsilicone oil, methylphenylsilicone oil and methyl hydrogen silicone oil. Examples of the dimethylsilicone oil include KF96-10, KF96-100, KF96-1000, KF96H-10000, KF96H-12500 and KF96H-100000 (all of these names are trade names, manufactured by Shin-Etsu Chemical Co., Ltd.). Examples of the methylphenylsilicone oil include KF50-100, KF54 and KF56 (all of these names are trade names, manufactured by Shin-Etsu Chemical Co., Ltd.).

The modified silicone oil may be classified into reactive silicone oils and non-reactive silicone oils. Examples of the reactive silicone oils include amino-modified, epoxy-modified, carboxyl-modified, hydroxy-modified, methacryl-modified, mercapto-modified, phenol-modified or one-terminal reactive/hetero-functional group-modified silicone oils. Examples of the amino-modified silicone oil include KF-393, KF-857, KF-858, X-22-3680, X-22-3801C, KF-8010, X-22-161A and KF-8012 (all of these names are trade names, manufactured by Shin-Etsu Chemical Co., Ltd.). Examples of the epoxy-modified silicone oil include KF-100T, KF-101, KF-60-164, KF-103, X-22-343 and X-22-3000T (all of these names are trade names, manufactured by Shin-Etsu Chemical Co., Ltd.). Examples of the carboxyl-modified silicone oil include X-22-162C (trade name, manufactured by Shin-Etsu Chemical Co., Ltd.). Examples of the hydroxy-modified silicone oil include X-22-160AS, KF-6001, KF-6002, KF-6003, X-22-170DX, X-22-176DX, X-22-176D and X-22-176DF (all of these names are trade names, manufactured by Shin-Etsu Chemical Co., Ltd.). Examples of the methacryl-modified silicone oil include X-22-164A, X-22-164C, X-24-8201, X-22-174D and X-22-2426 (all of these names are trade names, manufactured by Shin-Etsu Chemical Co., Ltd.).

Reactive silicone oils may be hardened upon use, and may be classified into a reaction-curable type, photocurable type and catalyst-curable type. Among these types, silicone oil that is the reaction-curable type is particularly preferable. As the reaction-curable type silicone oil, products obtained by reacting an amino-modified silicone oil with an epoxy-modified silicone oil and then by curing are desirable. Also, examples of the catalyst-curable type or photocurable type silicone oil include KS-705F-PS, KS-705F-PS-1 and KS-770-PL-3 (all of these names are trade names, catalyst-curable silicone oils, manufactured by Shin-Etsu Chemical Co., Ltd.) and KS-720 and KS-774-PL-3 (all of these names are trade names, photocurable silicone oils, manufactured by Shin-Etsu Chemical Co., Ltd.). The addition amount of the curable type silicone oil is preferably 0.5 to 30% by mass based on the resin constituting the receptor layer. The releasing agent is used preferably in an amount of 2 to 4% by mass and further preferably 2 to 3% by mass based on 100 parts by mass of the polyester resin. If the amount is too small, the releasability cannot be secured without fail, whereas if the amount is excessive, a protective layer is not transferred to the image-receiving sheet resultantly.

Examples of the non-reactive silicone oil include polyether-modified, methylstyryl-modified, alkyl-modified, higher fatty acid ester-modified, hydrophilic special-modified, higher alkoxy-modified or fluorine-modified silicone oils. Examples of the polyether-modified silicone oil include KF-6012 (trade name, manufactured by Shin-Etsu Chemical Co., Ltd.) and examples of the methylstyryl-modified silicone oil include 24-510 and KF41-410 (all of these names are trade names, manufactured by Shin-Etsu Chemical Co., Ltd.). Modified silicones represented by any one of the following Formulae 1 to 3 may also be used.

Formula 1

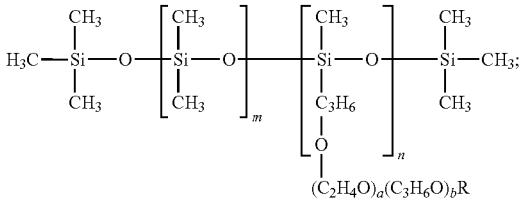

In the Formula 1, R represents a hydrogen atom or a straight-chain or branched alkyl group which may be substituted with an aryl or cycloalkyl group. m and n respectively denote an integer of 2,000 or less, and a and b respectively denote an integer of 30 or less.

Formula 2

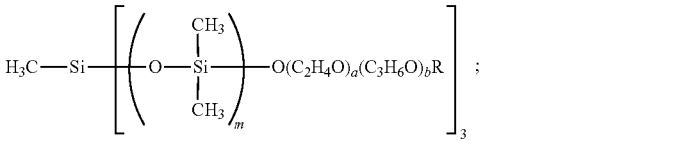

In the Formula 2, R represents a hydrogen atom or a straight-chain or branched alkyl group which may be substituted with an aryl or cycloalkyl group. m denotes an integer of 2,000 or less, and a and b respectively denote an integer of 30 or less.

Formula 3

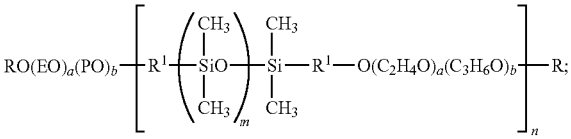

In the Formula 3, R represents a hydrogen atom or a straight-chain or branched alkyl group which may be substituted with an aryl or cycloalkyl group. m and n respectively denote an integer of 2,000 or less, and a and b respectively denote an integer of 30 or less. $R^1$ represents a single bond or a divalent linking group, E represents an ethylene group which may be further substituted, and P represents a propylene group which may be further substituted.

Silicone oils such as those mentioned above are described in "SILICONE HANDBOOK" (The Nikkan Kogyo Shimbun, Ltd.) and the technologies described in each publication of JP-A-8-108636 and JP-A-2002-264543 may be preferably used as the technologies to cure the curable type silicone oils.

In some cases, a dye binder is transferred to the receptor layer in a highlight portion of monochrome printing, to cause an irregular transfer. In addition, it is known that an addition polymerization-type silicone generally progresses a hardening reaction in the presence of a catalyst, and that almost all of complexes of transition metal of VIII group, such as Fe and Pt, are effective, as the hardening catalyst include. Among these, a platinum compound has the highest efficiency in general, and a platinum catalyst, which is generally a platinum complex soluble in the silicone oil, is preferably used. Addition amount necessary for the reaction is sufficiently about 1 to 100 ppm.

This platinum catalyst has a strong interaction with an organic compound containing an element such as N, P and S, an ionic compound of heavy metal such as Sn, Pb, Hg, Bi and As, or an organic compound containing a polyvalent bond such as an acetylene group. Therefore, if the above-described compounds (catalyst poison) are used together with the platinum catalyst, the ability of the catalyst to hydrosilylate is lost. Resultantly, the platinum catalyst cannot work as the hardening catalyst. Therefore, a problem arises that the platinum catalyst causes silicone to lack in hardening ability, when used with such a catalyst poison (See "Silicone Handbook" published by Nikkan Kogyo Shunbun shya). As a result, such an addition polymerization-type silicone causing such a hardening failure cannot show a releasability needed when it is used in the receptor layer. As a hardener reacting with an active hydrogen for use in the present invention, it is considered to use an isocyanate compound. However, this isocyanate compound and an organic tin compound working as a catalyst to the isocyanate compound act as a catalyst poison to the platinum catalyst. Therefore, the addition polymerization-type silicone has been never used together with the isocyanate compound in the past. Resultantly, the addition polymerization-type silicone has been never used together with a modified silicone having an active hydrogen, that shows a releasability needed, when hardened with the isocyanate compound.

However, the hardening failure of the addition polymerization-type silicone can be prevented by 1) setting an equivalent amount of the reactive group of the hardener capable of reacting with the active hydrogen, to the reactive group of both the thermoplastic resin and the modified silicone having an active hydrogen, in the range of from 1:1 to 10:1, and 2) setting an addition amount of the platinum catalyst based on the addition polymerization-type silicone in the range of 100 to 10,000 ppm in terms of platinum atom of the platinum catalyst. If the equivalent amount of the reactive group of the hardener capable of reacting with the active hydrogen according to the 1) described above is too small, an amount of silicone having an active hydrogen hardened with an active hydrogen of the thermoplastic resin is so small that an excellent releasability needed cannot be achieved. On the other hand, if the equivalent ratio is too large, a time which is allowed to use an ink in a coating solution for the receptor layer is so short that such the equivalent ratio cannot be substantially applied to the present invention.

The constitution of the present invention is described below.

The heat-sensitive transfer image-receiving sheet of the present invention has, on a support, at least one dye receptor layer (receptor layer). Further, it has at least one heat insulating layer (porous layer) between the support and the receptor layer.

On the back of the support, it is preferable to form a curling control layer, a writing layer and an electrification (charge) controlling layer. Each of the receptor layer, the heat insulating layer and various layers on the back of the support can be coated in accordance with a general method, such as roll coating, bar coating, gravure coating and gravure reverse coating.

(Receptor Layer)

The receptor layer plays a roll as receptor of dyes transferred from an ink sheet and a roll as retainer of the image formed. The receptor layer in the image-receiving sheet of the present invention contains the silicone compound(s) as mentioned above and a polymer containing repeating units derived from vinyl chloride as a polymer to receive dyes. The polymer may be a homopolymer or a copolymer (vinyl chloride copolymer), but it is preferably a copolymer.

Herein, the receptor layer may be formed of one layer, or two or more layers.

(Vinyl Chloride Copolymer)

Vinyl chloride copolymers usable in the receptor layer according to the present invention are described in detail.

The vinyl chloride copolymer is preferably one having a vinyl chloride constituent content of 85 to 97% by mass and a polymerization degree of 200 to 800. A monomer forming such a copolymer together with vinyl chloride has no particular restrictions, but any monomer may be used as far as it can be copolymerized with vinyl chloride. However, it is particularly preferably vinyl acetate. Accordingly, the vinyl chloride polymer used in the receptor layer in the present invention is advantageously a vinyl chloride-vinyl acetate copolymer. However, the vinyl chloride-vinyl acetate copolymer is not necessarily constituted of vinyl chloride and vinyl acetate alone, and may include vinyl alcohol and maleic acid constituents. Examples of other monomer constituents of such a copolymer constituted mainly of vinyl chloride and vinyl acetate include vinyl alcohol and its derivatives, such as vinyl alcohol and vinyl propionate; acrylic or methacrylic acids and their derivatives, such as acrylic acid and methacrylic acid, and their methyl, ethyl, propyl, butyl and 2-ethylhexyl esters; maleic acid and its derivatives, such as maleic acid, diethyl maleate, dibutyl maleate and dioctyl maleate; vinyl ether derivatives, such as methyl vinyl ether, butyl vinyl ether and 2-ethylhexyl vinyl ether; acrylonitrile and methacrylonitrile; and styrene. The ratio of each of the vinyl chloride and vinyl acetate components in the copolymer may be any ratio, but it is preferable that the ratio of the vinyl chloride component is 50 mass % or more of the copolymer. In addition, it is preferable that the ratio of the above-recited constituents other than the vinyl chloride and vinyl acetate is 10 mass % or less of the copolymer.

Examples of such a vinyl chloride-vinyl acetate copolymer include SOLBIN C, SOLBIN CL, SOLBIN CH, SOLBIN CN, SOLBIN C5, SOLBIN M, SOLBIN MF, SOLBIN A, SOLBIN AL, SOLBIN TA5R, SOLBIN TAO, SOLBIN MK6, and SOLBIN TA2 (trade names, manufactured by Nissin Chemical Industry Co., Ltd.); S-LEC A, S-LEC C and S-LEC M (trade names, manufactured by Sekisui Chemical Co., Ltd.); Vinylite VAGH, Vinylite VYHH, Vinylite VMCH, Vinylite VYHD, Vinylite VYLF, Vinylite VYNS, Vinylite VMCC, Vinylite VMCA, Vinylite VAGD, Vinylite VERR and Vinylite VROH (trade names, manufactured by Union Carbide Corporation); and DENKA VINYL 1000GKT, DENKA VINYL 1000L, DENKA VINYL 1000CK, DENKA VINYL 1000A, DENKA VINYL 1000LK$_2$, DENKA VINYL 1000AS, DENKA VINYL 1000MT$_2$, DENKA VINYL 1000CSK, DENKA VINYL I OOCS, DENKA VINYL 1000GK, DENKA VINYL 1000GSK, DENKA VINYL 1000GS, DENKA VINYL 1000LT$_3$, DENKA VINYL 1000D and DENKA VINYL 1000W (trade names, manufactured by Denki Kagaku Kogyo Kabushiki Kaisha).

(Plasticizer)

For the purpose of enhancing the sensitivity of the receptor layer, a plasticizer may also be added. Examples of such a plasticizer include compounds generally used as plasticizers for vinyl chloride resins, and more specifically monomeric plasticizers such as phthalates, phosphates, adipates and sebacates, and polyester-type plasticizers produced by polymerization of adipic acid or sebacic acid and polyethylene glycol. Although the former plasticizers are generally low in molecular weight, other polymeric plasticizer usable for vinyl chloride resins may be olefin-type special copolymer resins. Examples of resins usable for such a purpose include products marketed under the trade names of ELVALOY 741, ELVALOY 742, ELVALOY HP443, ELVALOY EP4051 (trade names, manufactured by DuPont-Mitsui Polychemicals Co., Ltd.). Such plasticizers can be added to the resins in a proportion of about 100% by mass, but it is appropriate to use them in a proportion of 30% by mass or below in view of bleeding of prints.

The receptor layer for use in the present invention can be cast by extrusion coating of a fused matter of the polymer resin as recited above without resorting to solvent coating. The techniques of this extrusion coating are described in Encyclopedia of Polymer Science and Engineering, vol. 3, p. 563, John Wiley, New York (1985), and supra, vol. 6, p. 608 (1986). In addition, the technique for heat-sensitive dye transfer materials is disclosed in JP-A-7-179075, and it is also applicable to the present invention. As the polymer resin, copolymer obtained by condensing cyclohexane dicarboxylate and a 50:50 by mole % mixture of ethylene glycol and bisphenol-A-diethanol (COPOL; trade mark) is especially preferred.

(Thermoplastic Resin other than Vinyl Chloride Copolymer)

The receptor layer for use in the present invention can contain other thermoplastic resins as far as a vinyl chloride copolymer is incorporated therein. In this case, other thermoplastic resins used in combination with a vinyl chloride copolymer are preferably those having compatibility with the vinyl chloride copolymer.

Examples of other thermoplastic resins usable in combination with the vinyl chloride copolymer include vinyl resins, such as polyvinyl acetate, ethylene-vinyl acetate copolymer, polyacrylic ester, polystyrene and polystyrene-acryl; acetal resins, such as polyvinyl formal, polyvinyl butyral and polyvinyl acetal; polyester resins, such as polyethylene terephthalate, polybutylene terephthalate and polycaprolactone (PLACCEL H-5, a product of Daicel Chemical Industries, Ltd.); polycarbonate resins; cellulose resins, such as the cellulose resins disclosed in JP-A-04-296595 and JP-A-2002-264543, and cellulose acetate butyrate (CAB551-0.2 and CAB321-0.1, products of Eastman Chemical Company); polyolefin resins, such as polypropylene; and polyamide resins, such as urea resin, melamine resin and benzoguanamine resin. These resins may also be blended in arbitrary proportions as far as their compatibility can be kept. The resins forming the receptor layers are also disclosed in JP-A-57-169370, JP-A-57-207250 and JP-A-60-25793.

(Releasing Agent Other Than Silicone Compound)

The receptor layer for use in the present invention contains a silicone compound as a releasing agent, and besides, another releasing agent can be used therein as a complement to the silicone compound. Releasing agents usable as such complements are those known in the technical field concerned, with examples including solid waxes, such as carnauba wax, montan acid wax, microcrystalline wax, polyethylene wax, amide wax and Teflon powder, phosphoric ester compounds and fluorine-containing surfactants.

(Ultraviolet Absorber)

Also, in the present invention, in order to improve light resistance, an ultraviolet absorber may be added to the receptor layer. In this case, when this ultraviolet absorber is made to have a higher molecular weight, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. When the polymer is made to be used in a form of a latex, an aqueous dispersion-system coating solution may be used in application and coating to form the receptor layer, and this enables reduction of production cost. As a method of making the latex polymer (or making the polymer latex-wise), a method described in, for example, Japanese Patent No.3,450,339 may be used. As the ultraviolet absorber to be used in a form of a latex, the following commercially available ultraviolet absorbers may be used which include ULS-700, ULS-1700, ULS-1383MA, ULS-1635MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the ultraviolet-absorber-grafted polymer or its latex is preferably 5 to 50 parts by mass, and more preferably 10 to 30 parts by mass, to 100 parts by mass of the receptor polymer latex capable of being dyed to be used to form the receptor layer. The amount of the receptor layer to be applied is preferably 0.5 to 10 g/m$^2$ (solid basis, hereinafter, the amount to be applied in the present specification means a value on solid basis unless otherwise noted). The film thickness of the receptor layer is preferably 1 to 20 μm.

(Heat Insulating Layer)

The heat insulating layer inhibits heat diffusion into a support across an ink sheet and a receptor layer at the time of heat transfer using a thermal head, and contributes to an increase in amounts of transferred dyes. Further, it plays a role of a heat protector for the support. Also, because the heat insulation layer has high cushion characteristics, a heat-sensitive transfer image-receiving sheet having high printing sensitivity can be obtained even in the case of using paper as a substrate (support). The heat insulation layer may be a single layer, or multi-layers. The heat insulation layer is arranged at a nearer location to the support than the receptor layer.

In the image-receiving sheet of the present invention, it is advantageous to form a heat insulating layer having a void structure by incorporation of hollow polymer particles. The hollow polymer particles in the present invention is polymer particles having independent pores inside of the particles. Examples of the hollow polymer particles include (1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

These hollow polymer particles preferably have a hollow ratio of about 20 to 70%, and may be used in combinations of two or more. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461DE, 551DE and 551DE20 manufactured by Nippon Ferrite (all of these product names are trade names). The hollow polymer particles for use in the heat insulation layer may be a latex thereof.

A water-dispersible resin or water-soluble type resin is preferably contained, as a binder, in the heat insulation layer containing the hollow polymer particles. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. Also, these resins may be used either singly or as mixtures.

The solid content of the hollow polymer particles in the heat insulation layer preferably falls in a range from 5 to 2,000 parts by mass when the solid content of the binder resin is 100 parts by mass. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, posing problems, for example, powder fall or film separation.

The particle size of the hollow polymer particles is preferably 0.1 to 20 μm, more preferably 0.1 to 2 μm and particularly preferably 0.1 to 1 μm. Also, the glass transition temperature (Tg) of the hollow polymer particles is preferably 70° C. or more and more preferably 100° C. or more.

In addition, it is preferable that the heat insulating layer contains a water-soluble polymer as recited above.

<Water-soluble Polymer>

Herein, the water-soluble polymer means a polymer which dissolves, in 100 g water at 20° C., in an amount of preferably 0.05 g or more, more preferably 0.1 g or more, further preferably 0.5 g or more, and particularly preferably 1 g or more. The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention.

Among the water-soluble polymers which can be used in the present invention, the natural polymers and the semi-synthetic polymers will be explained in detail. Specific examples include the following polymers: plant type polysaccharides such as gum arabics, κ-carrageenans, τ-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Of the water-soluble synthetic polymers that can be used in the present invention, the polyvinyl alcohols are explained in detail below.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0+0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS];

PVA-224 [PVA content: 94.0 mass %; degree of saponification: 88.0±1.5 mol %; content of sodium acetate: 1.0 mass %; volatile constituent: 5.0 mass %; viscosity (4 mass %; 20 ° C): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 0.1 mass %; volatile constituent: 5.0 mass %; viscosity (4 mass %; 20° C.): 95.0±15.0 CPS];

PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS];

PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS];

PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS];

VA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L78 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Karikokai, Inc. are useful. The modified polyvinyl alcohols include polyvinyl alcohols modified by cations, anions, -SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL- 118, KL-318, KL-506, KM-I 18T, and KM-618 (all being trade names of Kuraray Co., Ltd.); M polymers such as M-115 (a trade name of Kuraray co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R- 1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated surface quality can be improved by an addition of boric acid. The amount of boric acid added is preferably 0.01 to 40 mass % with respect to polyvinyl alcohol.

Preferred binders are transparent or semitransparent, generally colorless, and water-soluble. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrene/butadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides.

The amount of water-soluble polymer added to the heat insulating layer is preferably from 1 to 75% by mass, more preferably from 1 to 50% by mass, of the total ingredients in the heat insulating layer. Of water-soluble polymers containable in the barrier layer, gelatin is preferred. The proportion of gelatin in a coating solution for the heat insulating layer is preferably from 0.5 to 14% by mass, particularly preferably from 1 to 6% by mass. In addition, the coating amount of hollow polymer particles in the heat insulating layer is preferably from 1 to 100 g/m$^2$, more preferably from 5 to 20 g/m$^2$.

<Crosslinking Agent>

It is preferable that the above-mentioned water-soluble polymer contained in the heat insulating layer is partly or entirely crosslinked with the crosslinking agent.

The crosslinking agent is required to have a plurarity of groups capable of reacting with an amino group, a carboxyl group, a hydroxyl group or the like, but the agent to be used may be suitably selected depending on the kind of the water-soluble polymer. Thus, there is no particular limitation for the kind of the crosslinking agent. It is suitable to use each of methods described in T. H. James; "THE THEORY OF THE PHOTOGRAPHIC PROCESS FOURTH EDITION", published by Macmillan Publishing Co., Inc. (1977), pp. 77 to 87, and crosslinking agents described in, for example, U.S. Pat. No. 4,678,739, col. 41; JP-A-59-116655, JP-A-62-245261, and JP-A-61-18942. Both crosslinking agents of an inorganic compound (e.g., chrome alum, boric acid and salts thereof) and crosslinking agents of an organic compound may be preferably used. Alternatively, the crosslinking agent to be used may be a mixture solution containing a chelating agent and a zirconium compound, whose pH is in the range of 1 to 7, as described in JP-A-2003-231775.

Specific examples of the crosslinking agent include epoxy compounds (e.g., diglycidyl ethyl ether, ethyleneglycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds described in JP-A-6-329877, JP-A-7-309954 and the like, and DIC FINE EM-60 (trade name, munufactured by DAINIPPON INK AND CHEMICALS, INCORPORATED)), aldehyde compounds (e.g., formaldehyde, glyoxal, gluralaldehyde), active halogen compounds (e.g., 2,4-dichloro-4-hydroxy-1,3,5-s-triazine, and compounds described in U.S. Pat. No. 3,325,287 and the like), active vinyl compounds (e.g., 1,3,5-trisacryloyl-hexahydro-s-triazine, bisvinylsulfonylmethyl ether, N,N'-ethylene-bis(vinylsulfonylactamido) ethane, and compounds described in JP-B-53-41220, JP-B-53-57257, JP-B-59-162546, JP-B-60-80846 and the like), mucohalogen acid compounds (e.g., mucochloric acid), N-carbamoylpyridinium salt compounds (e.g., (1-morpholinocarbonyl-3-pyridinio)methanesulfonate), haloamidinium salt compounds (e.g., 1-(1-chloro-1-pyridinomethylene)pyrrolidinium, 2-naphthalenesulfonate), N-methylol compounds (e.g., dimethylolurea, methyloldimethylhydantoin), carbodiimido compounds (e.g., polycarbodiimido compounds derived from isoholondiisocyanate as described in JP-A-59-187029 and JP-B-5-27450, carbodiimido compounds derived from tetramethylxylylene diisocyanate as described in JP-A-7-330849, multi-branch type carbodiimido compounds described in JP-A-10-30024, carbodiimido compounds derived from dicyclohexylmethane diisocyanate as described in JP-A-2000-7642, and CARBODILITE V-02, V-02-L2, V-04, V-06, E-01 and E-02 (trade names, manufactured by Nisshinbo Industries, Inc.)), oxazoline compounds (e.g., oxazoline compounds described in JP-A-2001-215653 and EPOCROS K-IOIOE, K-1020E, K-1030E, K-2010E, K-2020E, K-2030E, WS-500 and WS-700 (trade names, manufactured by NIPPON SHOKUBAI CO., LTD.)), isocyanate compounds (e.g., dispersible isocyanate compounds described in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, and Duranate WB40-100, WB40-80D, WT20-100 and WT30-100 (trade names, manufactured by Asahi Kasei Corporation), CR-60N (trade name, manufactured by DAINIPPON INK AND CHEMICALS, INCORPORATED)), polymer (high molecular) hardeners (e.g., compounds described in JP-A-62-234157 and the like); boric acid and salts thereof, borax, and alum.

Preferable compounds as the crosslinking agent include epoxy compounds, aldehyde compounds, active halogen compounds, active vinyl compounds, N-carbamoylpyridinium salt compounds, N-methylol compounds (e.g., dimethylolurea, methyloldimethylhydantoin), carbodiimido compounds, oxazoline compounds, isocyanate compounds, polymer hardeners (e.g., compounds described in JP-A-62-234157 and the like), boric acid and salts thereof, borax, and alum. More preferable crosslinking agent include epoxy compounds, active halogen compounds, active vinyl compounds, N-carbamoylpyridinium salt compounds, N-methylol compounds (e.g., dimethylolurea, methyloldimethylhydantoin), polymer hardeners (e.g., compounds described in JP-A-62-234157 and the like) and boric acid.

The above-mentioned crosslinking agent may be used singly or in combination of two or more.

The crosslinking agent that can be used in the present invention may be added to the water-soluble polymer solution in advance, or may be added at the last step for the preparation of the coating solution. Alternatively, the crosslinking agent may be added just before the coating.

The water-soluble polymer in the heat insulating layer is preferably cross-linked in a ratio of from 0.1 to 20 mass %, more preferably from I to 10 mass %, among the entire water-soluble polymer, even though the ratio varies depending on the kind of the crosslinking agent.

The addition amount of the crosslinking agent that can be used in the present invention varies depending on the kinds of the water-soluble binder and the crosslinking agent, but it is preferable that the amount is approximately in the range of from 0.1 to 50 mass parts, more preferably from 0.5 to 20 mass parts, and further more preferably from 1 to 10 mass parts, based on 100 mass parts of the water-soluble polymer contained in the constituting layer.

In the image-receiving sheet of the present invention, it is preferred either a constitution in which the heat insulating layer does not contain an aqueous dispersion of resin having no resistance to an organic solvent other than hollow polymer particles (Constitution (1)) or a constitution in which the heat insulating layer does not contain an aqueous dispersion of resin having no resistance to an organic solvent other than hollow polymer particles and a vinyl chloride polymer (a polymer, preferably a copolymer, containing repeating units derived from vinyl chloride) (Constitution (2)).

A reason to adopt Constitution (1) is in that, when a resin having no resistance to an organic solvent (a resin capable of being dyed with coloring matter) is present in the heat insulating layer, an undesirable increase in bleeding of an image is caused after transfer. More specifically, the presence of a resin capable of being dyed with coloring matter and hollow polymer particles in the heat insulating layer is thought to allow diffusion of the coloring matter having dyed the receptor layer across its adjacent heat insulating layer with a lapse of time after transfer, thereby causing the bleeding.

Herein, the term "poor resistance to an organic solvent" means that a solubility in an organic solvent is I mass % or more, preferably 0.5 mass % or more. For example, the above-mentioned polymer latex is included in the category of the resin having "poor resistance to an organic solvent".

The adoption of Constitution (2), though disadvantageous in terms of easy diffusion of coloring matter as explained above, has an advantage in that the bonding force at the interface between the receptor layer and the heat insulating layer is strengthened. In this constitution also, it is possible to practically inhibit diffusion of coloring matter by holding down the addition amount of vinyl chloride polymer (polymer, preferably copolymer, containing repeating units derived from vinyl chloride), preferably a latex thereof.

(Vinyl Chloride Copolymer Latex)

A vinyl chloride copolymer latex added to the heat insulating layer in Constitution (2) is described below.

The vinyl chloride copolymer latex which can be used in the present invention refers to a disperse system obtained by dispersing fine particles of a hydrophobic polymer containing water-insoluble vinyl chloride as a monomer unit into a dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle size distribution of the dispersed particles is not particularly limited, and the particles may have either wide particle-size distribution or monodispersed particle-size distribution.

The latex polymer for use in the present invention may be latex of the so-called core/shell type, other than ordinary latex polymer of a uniform structure. When using a core/shell type latex polymer, it is preferred in some cases that the core and the shell have different glass transition temperatures. The glass transition temperature (Tg) of the latex polymer for use in the present invention is preferably −30° C. to 100° C., more preferably 0° C. to 80° C., further more preferably 10° C. to 70° C., and especially preferably 15° C. to 60° C.

In the present invention, as a preferable embodiment of the polymer latex used in the receptor layer, there can be preferably used polyvinyl chlorides, a copolymer comprising a monomer unit of vinyl chloride such as a vinyl chloride-vinyl acetate copolymer, and a vinyl chloride acrylate copolymer. In case of the copolymer, the vinyl chloride monomer ratio is preferably in the range of from 50% to 95%. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to the layer containing the latex, and polymers having excessively large molecular weight bring about poor filming ability, and therefore both cases are undesirable. Crosslinkable latex polymers are also preferably used.

The polymer latex that can be used in the present invention is commercially available, and polymers described below may be utilized. Examples thereof include G351 and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 90OGT, 938 and 950 (trade names, manufactured by Nissin Chemical Industry Co., Ltd.).

These latex polymers may be used singly, or two or more of these polymers may be blended, if necessary.

The amount of the vinyl chloride copolymer latex added to the heat insulating layer is preferably from 1 to 75% by mass, far preferably from 1 to 50% by mass, further preferably from 1 to 25% by mass, of the total ingredients in the heat insulating layer.

A thickness of the heat insulation layer containing the hollow polymer particles is preferably from 5 to 50 μm, more preferably from 5 to 40 μm.

<Emulsified Dispersion>

In the present invention, incorporation of an emulsified dispersion (emulsion) in the heat insulating layer is preferable, especially when the polymer latex is used.

The term "emulsification" as used herein follows the commonly used definition. According to "Kagaku Daijiten (ENCYCLOPAEDIA CHIMICA)", Kyoritsu Shuppan Co., Ltd., for example, "emulsification" is defined as "a phenomenon in which, in one liquid, another liquid which does not dissolve in the first liquid are dispersed as fine globules, to form an emulsion". In addition, the term "emulsified dispersion" refers to "a dispersion in which fine globules of one liquid are dispersed in another liquid which does not dissolve the globules". The "emulsified dispersion" preferred in the present invention is "a dispersion of oil globules in water". The content of an emulsified dispersion in the image-receiving sheet of the present invention is preferably from 0.03 g/m$^2$ to 25.0 g/m$^2$, more preferably from 1.0 g/m$^2$ to 20.0 g/m$^2$.

In the present invention, it is preferable that a high-boiling solvent be included as an oil-soluble substance in the emulsified dispersion. Examples of the high-boiling solvent preferably used include phthalic acid esters (such as dibutyl phthalate, dioctyl phthalate, and di-2-ethyl-hexyl phthalate), phosphoric or phosphonic acid esters (such as triphenyl phosphate, tricresyl phosphate, tri-2-ethylhexyl phosphate), fatty acid esters (such as di-2-ethylhexyl succinate and tributyl citrate), benzoic acid esters (such as 2-ethylhexyl benzoate and dodecylbenzoate), amides (such as N,N-diethyldodecanamide and N,N-dimethyloleinamide), alcohol and phenol compounds (such as isostearyl alcohol and 2,4-di-tert-amylphenol), anilines (such as N,N-dibutyl-2-butoxy-5-tert-octylaniline), chlorinated paraffins, hydrocarbons (such as dodecylbenzene and diisopropylnaphthalene), and carboxylic acids (such as 2-(2,4-di-tert-amylphenoxy)butyric acid). Of these high-boiling solvents, phosphoric or phosphonic acid esters (such as triphenyl phosphate, tricresyl phosphate, and tri-2-ethylhexyl phosphate) are preferred over the others. In addition to such a high-boiling solvent, an organic solvent having a boiling point of 30° C. to 160° C. (such as ethyl acetate, butyl acetate, methyl ethyl ketone, cyclohexanone, methyl cellosolve acetate, or dimethylformamide) may be used as an auxiliary solvent. The content of high-boiling solvent in the emulsified dispersion is preferably from 3.0 to 25% by mass, and more preferably from 5.0 to 20% by mass.

It is preferable that the emulsified dispersion further contain an agent for imparting fastness to images and an ultraviolet absorbent. The compounds preferably used as such agents are any of the compounds represented by formulae (B), (Ph), (E-1) to (E-3), (TS-I) to (TS-VII), (TS-VIIIA), (UA) to (UE) disclosed in JP-A-2004-361936. Further, homopolymers or copolymers insoluble in water and soluble in organic solvents (preferably the compounds disclosed in JP-A-2004-361936, paragraph Nos. 0208 to 0234) may be included therein.

(Undercoat Layer)

An undercoat layer may be formed between the receptor layer and the heat insulation layer. As the undercoat layer, for example, a white background regulation layer, a charge regulation layer, an adhesive layer or a primer layer is formed. These layers may be formed in the same manner as those described in, for example, each specification of Japanese Patent Nos. 3,585,599 and 2,925,244.

(Support)

In the present invention, a waterproof support is preferably used as the support. The use of the waterproof support makes it possible to prevent the support from absorbing moisture, whereby a fluctuation in the performance of the receptor layer with time can be prevented. As the waterproof support, for example, coated paper or laminate paper may be used.

-Coated Paper-

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

-Laminated Paper-

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, both of the high-density polyethylene and the low-density polyethylene have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

The method of producing the heat-sensitive transfer image-receiving sheet of the present invention is explained below.

The heat-sensitive transfer image-receiving sheet of the present invention may be prepared by coating each of layers using a usual method such as a roll coating, a bar coating, a gravure coating and a gravure reverse coating, followed by drying the layers.

Alternatively, the heat-sensitive transfer image-receiving sheet of the present invention may be also prepared by simultaneous double-layer coating the receptor layer and the heat insulation layer on the support.

It is known that in the case of producing an image-receiving sheet composed of plural layers having different functions from each other (for example, an air cell layer, heat insulation layer, intermediate layer and receptor layer) on a support, it may be produced by applying and overlapping each layer one by one or by applying materials prepared in advance by coating a support with each layer, as shown in, for example, JP-A-2004-106283, JP-A-2004-181888 and JP-A-2004-345267. It has been known in photographic industries, on the other hand, that productivity can be greatly improved by applying plural layers simultaneously as a multilayer. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050; and Edgar B. Gutoff, et al., "Coating and Drying Defects: Troubleshooting Operating Problems", John Wiley & Sons Company, 1995, pp. 101-103.

In the present invention, it has been found that the productivity is greatly improved and image defects can be remarkably reduced at the same time, by using the above simultaneous multilayer coating for the production of an image-receiving sheet having a multilayer structure.

A plurality of layers in the present invention are generally made up mainly of resins. A coating solution for forming each layer is preferably a latex aqueous dispersion. For the receptor layer, however, a homogeneous solution of polymer in a solvent may be used since the receptor layer requires adding a silicone compound. The solid content by mass of the resin put in a latex state in each layer coating solution is preferably in a range from 5 to 80 mass % and particularly preferably 20 to 60 mass %. The average particle size of the resin contained in the above water-dispersed latex is preferably 5 μm or less and particularly preferably 1 μm or less. The above water-dispersed latex may contain a known additive, such as a surfactant, a dispersant, and a binder resin, according to the need.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. Also, in the case where a binder (e.g., a gelatin) to be gelled at lower temperatures is contained, there is the case where it is preferable to drop the temperature immediately after the plural layers are formed on the support.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

A heat-sensitive transfer sheet (ink sheet) to be used together with the aforementioned heat-sensitive transfer image-receiving sheet according to the present invention in the formation of a thermal-transferred image, can be produced by disposing a dye layer containing a diffusion transfer dye on a support. As the heat-sensitive transfer sheet, any ink sheet may be used. As a means for providing heat energy in the thermal transfer, any of the conventionally known providing means may be used. For example, a heat energy of about 5 to 100 mJ/mm$^2$ is applied by controlling recording time in a recording device such as a thermal printer (trade name: Video Printer VY-100, manufactured by Hitachi, Ltd.), whereby the expected object can be attained sufficiently.

Also, the heat-sensitive transfer image-receiving sheet of the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

The present invention may be utilized for printers, copying machines and the like, which employs a heat-sensitive transfer recording system.

According to the present invention, it is possible to provide a heat-sensitive transfer image-receiving sheet and an image-forming method for providing an image of high quality by ensuring the high density for the image transferred thereto even in high-speed processing, and preventing delamination of its receptor layer and image failure due to thermal fusion of an ink sheet from occurring at the time of thermal transfer.

The present invention will be described in more detail based on the following examples, but the invention is not intended to be limited thereto. In the following Examples, the terms "part" and "%" are values by mass, unless they are indicated differently in particular.

EXAMPLES

Reference Example (Production of an ink sheet)

A polyester film 6.0 μm in thickness (trade name: Lumirror, manufactured by Toray Industries, Inc.) was used as the substrate film. A heat resistant slip layer (thickness: μm) was formed on the backside of the film, and the following yellow, magenta and cyan compositions and the following composition of a protective layer were respectively applied as a monochromatic layer (coating amount: 1 g/m$^2$ when the layer was dried) on the front side.

| Yellow composition | |
|---|---|
| Dye (trade name: Macrolex Yellow 6G, manufactured by Byer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Magenta composition** | |
| Magenta dye (Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Cyan composition** | |
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Composition of Protective Layer** | |
| Polyvinylacetal resin (Trade name: KS-10, manufactured by Sekisui Chemical Co., Ltd.) | 5.5 parts by mass |
| Colloidal silica (IPA-ST, trade name, a product of Nissan Chemical Industries, Ltd.) | 4 parts by mass |
| Diethyl ketone/isopropyl alcohol (8/2, at mass ratio) | 90 parts by mass |

Example 1

1. Preparation of an image-receiving sheet (Preparation of Support)

A pulp slurry was prepared from 50 parts by mass of hardwood kraft pulp (LBKP) of acacia origin and 50 parts by mass of hardwood kraft pulp (LBKP) of aspen origin, by beating these pulps by means of a disk refiner until Canadian standard freeness reached to 300 ml.

To the pulp slurry thus prepared were added, on a pulp basis, 1.3 mass % of modified cationic starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZEPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The resulting pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, then, dried and further subjected to calendering treatment. Therein, the papermaking was performed so that the raw paper had a grammage (basis weight) of 157 g/m$^2$, and the raw paper (base paper) having a thickness of 160 μm was obtained.

The wire side (back side) of the base paper obtained was subjected to corona discharge treatment, and thereto a resin composition, in which a high-density polyethylene having an MFR (which stands for a melt flow rate, and hereinafter has the same meaning) of 16.0 g/10 min and a density of 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene having an MFR of 4.0 g/10 min and a density of 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side".) The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating had a dry mass of 0.2 g/m$^2$. Subsequently, the front surface (front side) of the base paper was subjected to corona discharge treatment, and then coated with 27 g/m$^2$ of a low-density polyethylene having an MFR of 4.0 g/10 min and a density of 0.93 g/m$^2$ and containing 10 mass % of titanium oxide, by means of a melt extruder, thereby forming a thermoplastic resin layer with a specular surface.

(Preparation of Emulsified Dispersion)

An emulsified dispersion A was prepared in the following manner. Compound A-6 mentioned above was dissolved in a mixture of 42 g of a high-boiling solvent (Solv-1) and 20 ml of ethyl acetate, and the resulting solution was emulsified and dispersed in 250 g of a 20 mass % aqueous gelatin solution containing 1 g of sodium dodecylbenzenesulfonate by means of a high-speed stirring emulsification machine (dissolver). Thereto, water was added to prepare 380 g of an emulsified dispersion A.

Therein, the addition amount of compound A-6 was adjusted so that the compound would be contained in an amount of 30 mmoles in the emulsified dispersion A.

Solv-1

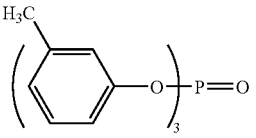

A-6

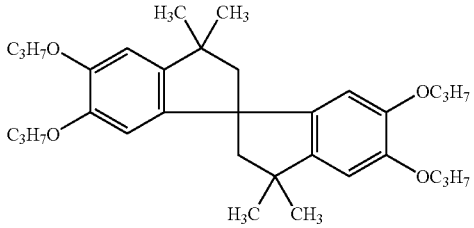

(Preparation of an Image-receiving Sheet)

On the thus prepared support, a subbing layer 1, a subbing layer 2 and a heat insulating layer were coated by a simultaneous double-layer coating; in the increasing order of distance from the support so as to have a multilayer structure, thereby making a multilayer-structure coated product 101. To this coated product, a coating solution for a receptor layer was applied to make Sample 101. The composition and coating amount of coating solution for each layer are shown below.

| Coating solution for subbing layer 1 (Composition) Aqueous solution prepared by adding 1% sodium dodecylbenzenesulfonate to 3% aqueous gelatin solution | |
|---|---|
| NaOH for adjusting pH to 8 | 11 ml/m$^2$ |
| (Coating amount) | |

| Coating solution for subbing layer 2 (Composition) | |
|---|---|
| Styrene-butadiene latex (SR103 (trade name), manufactured by Nippon A & L Inc.) | 60 parts by mass |
| 6% Aqueous solution of polyvinyl alcohol (PVA) | 40 parts by mass |
| NaOH for adjusting pH to 8 | 11 ml/m$^2$ |
| (Coating amount) | |

| Coating solution for heat insulation layer 1 (Composition) | |
|---|---|
| Hollow polymer latex (MH5055 (trade name), manufactured by Zeon Corporation) | 60 parts by mass |
| 10% Gelatin aqueous solution | 20 parts by mass |
| Emulsified dispersion A prepared in the above | 20 parts by mass |
| Compound X (crosslinking agent) | 2 parts by mass |
| NaOH for adjusting pH to 8 | 45 ml/m$^2$ |
| (Coating amount) | |

| Coating solution for Receptor layer (Composition) | |
|---|---|
| Vinyl chloride/vinyl acetate copolymer (Trade name: Solbin A, manufactured by Nissin Chemical Industry Co., Ltd.) | 80 parts by mass |
| Polyester resin (Trade name: Vylon 600, manufactured by Toyobo Co., Ltd.) | 20 parts by mass |
| Amino-modified silicone (Trade name: KS-343, manufactured by Shin-Etsu Chemical Co., Ltd.) | 5 parts by mass |
| Epoxy-modified silicone (Trade name: KF-393, manufactured by Shin-Etsu Chemical Co., Ltd.) | 5 parts by mass |
| Platinum curing catalyst (Trade name: PL-50T, manufactured by Shin-Etsu Chemical Co., Ltd.) | 3 parts by mass |
| Methyl ethyl ketone/toluene (=1/1, at mass ratio) | 400 parts by mass |
| (Coating amount) | 25 ml/m$^2$ |

Samples 102 to 110 were prepared in the same manner as Sample 101, except that the composition of coating solution for the receptor layer of Sample 101 was changed to those shown in Table 1, respectively.

Sample 201 was prepared in the same manner as Sample 101, except that the heat insulating layer provided in Sample 101 was omitted.

Samples 301 and 302 were prepared in the same manners as Samples 101 and 102, respectively, except that the coating solution used for the heat insulating layers of Samples 101 and 102 was changed to the following coating solution 2 for a heat insulating layer.

| Coating solution for heat insulation layer 2 (Composition) | |
|---|---|
| Hollow polymer latex (MH5055 (trade name), manufactured by Zeon Corporation) | 60 parts by mass |
| Vinyl chloride-series latex (Trade name: VINYBLAN 609, manufactured by Nissin Chemical Industry Co., Ltd.) | 10 parts by mass |
| 10% Gelatin aqueous solution | 10 parts by mass |
| Emulsified dispersion A prepared in the above | 20 parts by mass |
| Compound X (crosslinking agent) | 2 parts by mass |
| NaOH for adjusting pH to 8 | |

-continued

| Coating solution for heat insulation layer 2 (Composition) | |
|---|---|
| (Coating amount) | 45 ml/m$^2$ |
| Compound X | |

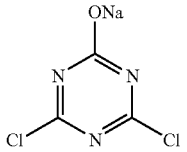

(Image Formation and Evaluation)

The ink sheet prepared in the reference example and each of the image-receiving sheets mentioned above were worked to be made loadable in a sublimation printer, DPB 1500 (trade name, manufactured by Nidec Copal Corporation), and image outputs were produced on those image-receiving sheets in settings that permit production of all the gradations (shades) of gray from the minimum density to the maximum density in a high-speed printing mode. Herein, output of one L-size print took 13 seconds.

For evaluation of transferring property of dyes, densities of images obtained by transferring of dyes were estimated. Samples delivering appropriate densities as a whole and presenting no problem were rated as good (○), samples delivering apparently inappropriate densities were rated as bad (X), and samples that could not undergo any processing and were incapable of evaluation were symbolized by a hyphen (-).

Evaluation of the presence or absence of image defects was made by use of outputs produced in the form of overall solid gray images having a reflection density of 0.7. Samples having no problems with image quality were rated as excellent (◎), those having almost no problems with image quality although, abnormal transfer was observed in part of edge area were rated as good (○), those suffering partial delamination of their receptor layers were rated as poor (Δ), those suffering delamination of their receptor layers in their entirety were rated as very poor (X), and those causing sheet jams during processing to result in processing failure were rated as conspicuously poor (X X).

Results obtained are shown in Table 1. These results indicate that the combination of incorporation of hollow polymer particles in heat insulating layer and possession of a receptor layer having a silicone compound and a vinyl chloride copolymer resin has transferring property of dyes and satisfactory processing suitability. Further, by combining a vinyl chloride latex with the hollow polymer particles in the heat insulating layer, an improvement in the processing suitability is seen.

TABLE 1

| | Composition of | Composition of receptor layer | | | | | | | | | | Evaluation | |
|---|---|---|---|---|---|---|---|---|---|---|---|---|---|
| Sample No. | heat insulation layer | Vinyl chloride resin | | Other resin | | Silicone compound 1 | | Silicone compound 2 | | Catalyst | | Remarks | Image defects | Transferring property of dyes |
| 101 | Heat insulation layer 1 | Solbin A | 80 parts | Vylon 600 | 20 parts | KF-393 | 5 parts | KS-343 | 5 parts | PL-50T | 3 parts | This invention | ○ | ○ |
| 102 | Heat insulation layer 1 | Solbin A | 100 parts | — | | KF-393 | 5 parts | KS-343 | 5 parts | PL-50T | 3 parts | This invention | ○ | ○ |
| 103 | Heat insulation layer 1 | — | | Vylon 600 | 100 parts | KF-393 | 5 parts | KS-343 | 5 parts | PL-50T | 3 parts | Comparative example | Δ | ○ |
| 104 | Heat insulation layer 1 | Solbin A | 80 parts | Vylon 600 | 20 parts | Silicone 1 | 5 parts | Silicone 2 | 5 parts | PL-50T | 3 parts | This invention | ◎ | ○ |
| 105 | Heat insulation layer 1 | Solbin A | 80 parts | Vylon 600 | 20 parts | KF-393 | 5 parts | X-22-3000T | 5 parts | PL-50T | 3 parts | This invention | ○ | ○ |
| 106 | Heat insulation layer 1 | Solbin A | 80 parts | Vylon 600 | 20 parts | KS705F | 7 parts | — | | CAT-PS-1 | 2 parts | This invention | ○ | ○ |
| 107 | Heat insulation layer 1 | — | | Vylon 200 | 100 parts | KF-393 | 5 parts | KS-343 | 5 parts | PL-50T | 3 parts | Comparative example | Δ | ○ |
| 108 | Heat insulation layer 1 | — | | LX410 | 100 parts | KF-393 | 5 parts | KS-343 | 5 parts | PL-50T | 3 parts | Comparative example | X | — |
| 109 | Heat insulation layer 1 | Solbin A | 80 parts | Vylon 600 | 20 parts | — | | — | | — | | Comparative example | X X | — |
| 110 | Heat insulation layer 1 | Solbin CI | 80 parts | Vylon 600 | 20 parts | KF-393 | 5 parts | KS-343 | 5 parts | PL-50T | 3 parts | This invention | ○ | ○ |
| 201 | None | Solbin A | 80 parts | Vylon 600 | 20 parts | KF-393 | 5 parts | KS-343 | 5 parts | PL-50T | 3 parts | Comparative example | ○ | X |
| 301 | Heat insulation layer 2 | Solbin A | 80 parts | Vylon 600 | 20 parts | KF-393 | 5 parts | KS-343 | 5 parts | PL-50T | 3 parts | This invention | ◎ | ○ |
| 302 | Heat insulation layer 2 | Solbin A | 100 parts | — | | KF-393 | 5 parts | KS-343 | 5 parts | PL-50T | 3 parts | This invention | ◎ | ○ |

Solbin A (Vinyl chloride/vinyl acetate copolymer, manufactured by Nissin Chemical Industry Co., Ltd.)

Solbin CI (Vinyl chloride/vinyl acetate copolymer, manufactured by Nissin Chemical Industry Co., Ltd.)

Vylon 600 (Polyester resin, manufactured by Toyobo Co., Ltd.)

Vylon 200 (Polyester resin, manufactured by Toyobo Co., Ltd.)

LX410 (SBR latex, manufactured by Zeon Corporation)

KF-393(Amino-modified silicone, manufactured by Shin-Etsu Chemical Co., Ltd.)

KS-343(Epoxy-modified silicone, manufactured by Shin-Etsu Chemical Co., Ltd.)

X-22-3000T (Epoxy-modified silicone, manufactured by Shin-Etsu Chemical Co., Ltd.)

KS-705F (Activated-by-energy-type silicone compound, manufactured by Shin-Etsu Chemical Co, Ltd.)

PL-50T(Platinum curing catalyst, manufactured by Shin-Etsu Chemical Co., Ltd.)

CAT-PS-1 (Catalyst, manufactured by Shin-Etsu Chemical Co., Ltd.)

Silicone 1 is an addition-polymerizable silicone compound that is constituted of 13 mole % of vinyl group-containing cyclohexane units, 30 mole % of diphenylsiloxane units and 57 mole % of dimethylsiloxane units and has a molecular weight of 7,000 (Compound A disclosed in JP-A-2002-356067).

Silicone 2 is a hydrogen-modified silicone compound that is constituted of 13 mole % of hydrogen-containing siloxane units, 30 mole % of diphenylsiloxane units and 57 mole % of dimethylsiloxane units and has a molecular weight of 7,000 (Compound a disclosed in JP-A-2002-356067).

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer image-receiving sheet, comprising: on a support, at least one receptor layer which contains at least one silicone compound and at least one polymer having repeating units derived from vinyl chloride; and, at least one heat insulating layer which contains a latex of hollow polymer particles and a latex polymer of a polymer having repeating units derived from vinyl chloride, between the receptor layer and the support, wherein the particle size of the hollow polymer particles is 0.1 to 2 μm, and wherein the hollow polymer particles are non-foaming type hollow particles and formed of styrene/acryl resin;

wherein the hollow polymer particles are obtained in the following steps:

forming a capsule wall formed of a styrene/acryl resin containing water inside of the capsule wall, applying a coating solution and drying the resultant, and vaporizing the water in the particles out of the particles so as to make the inside of each particle hollow.

2. The heat-sensitive transfer image-receiving sheet according to claim 1, wherein at least one of the silicone compounds is a reactive silicone oil.

3. The heat-sensitive transfer image-receiving sheet according to claim 1, wherein the receptor layer is a receptor layer coated by using a hydrophobic solvent.

4. The heat-sensitive transfer image-receiving sheet according to claim 1, wherein the amount of the latex polymer of a polymer having repeating units derived from vinyl chloride in the heat insulating layer is from 1 to 25% by mass, of the total ingredients in the heat insulating layer.

5. The heat-sensitive transfer image-receiving sheet according to claim 1, wherein the heat insulating layer contains a water-soluble polymer.

6. The heat-sensitive transfer image-receiving sheet according to claim 1, wherein the heat insulating layer contains a gelatin.

7. The heat-sensitive transfer image-receiving sheet according to claim 1, wherein the latex polymer of a polymer having repeating units derived from vinyl chloride in the heat insulating layer is a latex polymer of a vinyl chloride acrylate copolymer.

8. The heat-sensitive transfer image-receiving sheet according to claim 1, wherein the binder resin contained in the heat insulating layer contains only a water-soluble polymer and the latex polymer of a polymer having repeating units derived from vinyl chloride.

9. The heat-sensitive transfer image-receiving sheet according to claim 1, wherein the support is a two-sided laminated paper which is formed by laminating polyethylene on both sides of a base paper, wherein the polyethylene on the receptor layer side contains titanium dioxide, and wherein a charge-controlling layer is formed on the polyethylene which lies on the backside of the receptor layer side.

10. The heat-sensitive transfer image-receiving sheet according to claim 9, wherein the polyethylene which lies on the backside of the receptor layer side is a blend of a high-density polyethylene and a low-density polyethylene.

11. An image-forming method, comprising the steps of:

using heat-sensitive transfer image-receiving sheet according to claim 1, and a heat-sensitive transfer sheet having dyes on a support;

bringing these sheets into face-to-face contact with each other; and applying heat thereto, thereby to form a heat-sensitive transfer image.

12. The image-forming method according to claim 11, wherein at least one of the silicone compounds is a reactive silicone oil.

13. The image-forming method according to claim 11, wherein the receptor layer is a receptor layer coated by using a hydrophobic solvent.

14. The image-forming method according to claim 11, wherein the amount of the latex polymer of a polymer having repeating units derived from vinyl chloride in the heat insulating layer is from 1 to 25% by mass, of the total ingredients in the heat insulating layer.

15. The image-forming method according to claim 11, wherein the heat insulating layer contains a water-soluble polymer.

16. The image-forming method according to claim 11, wherein the heat insulating layer contains a gelatin.

17. The image-forming method according to claim 11, wherein the latex polymer of a polymer having repeating units derived from vinyl chloride in the heat insulating layer is a latex polymer of a vinyl chloride acrylate copolymer.

18. The image-forming method according to claim 11, wherein the binder resin contained in the heat insulating layer contains only a water-soluble polymer and the latex polymer of a polymer having repeating units derived from vinyl chloride.

19. The image-forming method according to claim 11, wherein the support is a two-sided laminated paper which is formed by laminating polyethylene on both sides of a base paper, wherein the polyethylene on the receptor layer side contains titanium dioxide, and wherein a charge-controlling layer is formed on the polyethylene which lies on the backside of the receptor layer side.

20. The image-forming method according to claim 19, wherein the polyethylene which lies on the backside of the receptor layer side is a blend of a high-density polyethylene and a low-density polyethylene.

* * * * *